United States Patent [19]

Avadani

[11] 4,210,843

[45] Jul. 1, 1980

[54] COLOR CRT SHADOW MASK AND METHOD OF MAKING SAME

[75] Inventor: Subramanya Avadani, Elmhurst, Ill.

[73] Assignee: Zenith Radio Corporation, Glenview, Ill.

[21] Appl. No.: 26,494

[22] Filed: Apr. 3, 1979

[51] Int. Cl.[2] ..... H01J 9/02

[52] U.S. Cl. ..... 313/403; 29/25.18; 313/402

[58] Field of Search ..... 29/25.17, 25.18; 313/402, 403

[56] References Cited

U.S. PATENT DOCUMENTS

| | | | |
|---|---|---|---|
| 3,676,914 | 7/1972 | Fiore | 29/25.18 |
| 3,693,223 | 9/1972 | Kaplan | 29/25.18 |
| 3,909,311 | 9/1975 | Yamada et al. | 148/12.1 |
| 3,909,928 | 10/1975 | Sato et al. | 29/558 |
| 3,973,964 | 8/1976 | Lange | 29/25.17 |
| 3,975,198 | 8/1976 | Palac et al. | 29/25.17 |
| 3,983,613 | 10/1976 | Palac et al. | 29/25.18 |

*Primary Examiner*—John McQuade
*Attorney, Agent, or Firm*—John H. Coult

[57] ABSTRACT

This disclosure depicts an improved method of making a color CRT shadow mask. The improved method comprises providing a plurality of shadow mask blanks each with a pattern of apertures photoetched therein, which blanks have been cut from a foil of steel, precision cold-rolled to a full hard condition with a thickness of about 6–8 mils. The sheet is characterized by being composed of an interstitial free steel material. A stack of the blanks is subjected to a limited annealing operation, by being carried out at a relatively low maximum temperature and for a relatively brief period sufficient only to achieve recrystallization of the material without causing significant grain growth. The maximum temperature is below the temperature at which the blanks mutually adhere, and thus avoiding any handling-related folding or creasing of the blanks normally associated with attempts to separate blanks stuck together in conventional high temperature annealing operations. Each blank is clamped and drawn to form a dished shadow mask without the interposition of vibration or roller leveling operations and thereby avoids undesirable creasing, roller marking, denting, tearing or work hardening of the blank normally associated with these operations. The end product shadow mask, due to the use of said interstitial free steel material, has an aperture pattern of improved definition as a result of more uniform stretching of the mask blank.

9 Claims, 3 Drawing Figures

COLOR CRT SHADOW MASK AND METHOD OF MAKING SAME

BACKGROUND OF THE INVENTION

This invention relates to an improved method of making color CRT shadow masks, particularly shadow masks of the slot type.

A shadow mask is a thin foil, typically composed of low carbon cold rolled steel, which is formed into a dished shape and suspended within a CRT envelope adjacent to the phosphor screen on the concave inner surface of the CRT faceplate. The mask has a central portion opposite the screen which is perforated with many thousands of tiny apertures, so sized and located as to insure that electron beams projected from the neck of the CRT impinge on phosphors of the appropriate red, blue and green emission characteristics.

The mask is often termed a "foil" because of its extreme thinness—typically between 6 and 8 thousandths of an inch. Because the foil from which the mask is formed is so thin, and because of the perforations in the mask, a shadow mask is extremely fragile. The fragility of the masks, and the extreme precision and uniformity requirements imposed on shadow mask manufacture, creates a set of manufacturing problems which are unique to the shadow-mask-making industry.

Until recently, nearly all shadow masks had an aperture pattern composed of circular holes; such masks were commonly termed "dot" masks. The associated phosphor screen took the form of a pattern of triads of phosphor dots of about the same size as the mask holes, emitting light in the red, blue and green parts of the visible spectrum. In recent times, the television industry, primarily for cost reasons, has introduced with near universal acceptance, shadow masks having a somewhat different aperture configuration. The apertures, rather than being arranged as a pattern of circular holes, is instead comprised of a pattern of vertically oriented slots, arranged in vertical rows, each slot being spaced by a "bridge" or "tie bar". The tie bars are desirably as narrow as can be made without unduly sacrificing the mechanical strength of the mask. Masks of this type have been termed "slot" masks and are typically used with phosphor screens comprising triads of red, blue and green phosphor stripes extending vertically throughout the entire height of the tube face.

Shadow masks of this type are even more fragile than masks of the dot type. In the vertical direction the mask comprises rows of slots separated only by narrow tie-bars, and is extremely weak in this direction. The mask is therefor very apt to fold along a vertical slot line. This type of handling-related mechanical defect is herein termed a "crease".

As will be shown, the extreme fragility of shadow masks, especially masks of the slot type, has in the past resulted in high losses during mask manufacture attributable to various types of handling-related mechanical defects. These losses can be translated into millions of dollars of cost to the television industry each year. As will be shown, because of the many other requirements and constraints imposed on the manufacture of shadow masks, the processes involved in making shadow masks today follow a sequence of operations which inevitably result in the introduction of into the mask product of a variety of handling-related mechanical defects. The occurrence of these costly defects were exacerbated when slot masks were introduced.

A typical shadow mask manufacturing process, as practiced today, will now be described. See FIG. 1. An ingot of rimmed cold rolled steel, No. 1008 for example, is hot rolled to about nominal 25 mils. It is then cold rolled to between 6–8 mils in thickness (Step A). This cold rolling operation is controlled to about ±0.1 mil—an extreme precision requirement. The cold rolling of the steel down to foil thickness results in a cold working of the material. The material in this condition is said to be "full hard."

The coil is cut and wound; it is then in condition for delivery to a mask maker. The mask maker feeds the coil into an in-line photoetching operation wherein the foil has formed therein spaced patterns of apertures. The photoetching operation includes coating both sides of the foil with a photoresist material (Step B), exposing the photoresist layers through registered aperture pattern masters (Step C), developing the coatings (Step D), baking the coatings to harden them (Step E), and etching through the developed photoresist layers from both sides (Step F). When the apertures are properly etched, the photoresist layer is chemically stripped away.

The foil is then cut into mask "blanks" (Step G). It is desirable that the foil be in a full hard condition during the etching and related operations in order that the mask maker does nut suffer high losses due to handling-related factors. Despite his most extreme efforts, however, the mask maker will suffer some losses due to dents, scratches, and other mechanical defects while in the process of etching and blanking the foil.

The mask blanks are flat and in a full hard condition but are not sufficiently ductile to be formed into the desired dished configuration (Step H). The blanks thus must be high temperature annealed to a dead soft condition to render them sufficiently ductile to be precision formed. The annealing is typically done in a decarburizing atmosphere at very high temperatures and for a relatively long period of time (Step I). A typical high temperature anneal cycle for slot mask blanks might be conducted at 900°–950° C. for 3½–5½ hours. (It is noted that 950° C. is the maximum temperature for many standard ovens of the type commonly employed.) Typically, dot masks may be annealed at the same temperature but for a more moderate length of time—2 hours for example. (More on this subject later) However, the annealing operation introduces a host of new problems for the CRT manufacturer.

The mask blanks, which are stacked in the annealing ovens stick together by a molecular thermal welding process, causing the masks to be difficult to separate. Because dot mask blanks are annealed for a shorter time than slot mask blanks, though at the same high temperatures, the sticking problem is somewhat less severe than with slot mask blanks. It has been found that if dot mask blanks are annealed in short stacks (10–12 or less), the sticking problem is tolerable. Such short stacks are permissible (though undesirable) because the anneal time is not excessive and therefore the annealer throughput rate is acceptable.

However, because the anneal cycle must be of such long duration for slot mask blanks in order to achieve an acceptable throughput rate, slot mask blanks must be stacked much higher in the ovens. To lessen the sticking problem for slot mask blanks and to promote a faster, more uniform anneal of the blanks, the stacks of mask blanks are each divided into sub-stacks separated by spacers—for example, six sub-stacks of five slot blanks per sub-stack. These spacers are conventionally of a window-screen-like construction which permits thermal circulation through the stack of blanks. Sticking could be eliminated altogether by separating each blank from its neighbor but this would be uneconomical.

The sub-stacks of blanks must be separated, and the sticking of these blanks to each other is apt to result in denting and creasing of the masks as they are pulled apart. To lessen this problem the stuck slot mask blanks are vibrated on a special vibrating table (Step K). This step lessens the degree of sticking, but does not overcome it altogether. Inevitably, some losses occur due to handling at the vibrating table.

The results of this sticking are particularly severe with slot type masks. Due to the bilateral symmetry of the aperture pattern in a slot mask blank, it must be stripped from the attached masks in the direction of maximum strength. If the operator does not follow this specification exactly, roller marking of the slot mask blank upon subsequent roller leveling is very apt to occur.

The spacers themselves introduce problems. When the spacers are removed from between the sub-stacks of blanks, scratching of the blanks may occur. Also, the spacers become brittle after a time and are apt to disintegrate, causing particulate matter to lodge on the mask blanks where it is apt to clog the apertures of the mask blank, or cause pimple dents upon subsequent roller leveling. Further, the spacer screens are costly and must be replaced frequently.

In addition, the annealing cycle causes an accelerated tendency of the mask blanks (dot and slot) to age. Aging of a mask blank is believed to be due to the diffusion of nitrogen and carbon atoms to the sites of dislocations within the material, causing the dislocations to be "pinned". If an aged blank is press-formed, it will yield nonuniformly and produce surface flutes or streaks called "stretcher strains" or "Luder lines". Stretcher strains passing through the perforate portion of the mask are apt to intolerably distort the mask apertures and the aperture pattern, resulting in a nonuniformly transmissive aperture pattern and thus a nonuniform black grille pattern. (It should be understood that the grille fabrication process is such that the grille is a replica of the shadow mask aperture pattern).

Still further, the high temperature annealing operation causes the mask blanks to wrinkle (Step J). Due to the presence of the wrinkles in the mask blanks and due to the aging of the mask blank material, the mask blanks must be flattened and the aging property overcome. This is accomplished by roller-leveling of the blanks (Step L).

Roller leveling flattens the blank and stretches the skin of the blank slightly beyond its yield point such that press-forming of the blank takes place in a smooth part of the plastic deformation region of the stress-strain curve, beyond the yield point. However, like the high temperature annealing operation, roller leveling also introduces a host of handling-related mechanical defects, causing further attrition of the population of blanks.

Because the blanks must be manually fed into the roller leveling apparatus, often as many as six or more times, a substantial percentage of the blanks are lost due to creasing, denting, roller marks, and other mechanical defects produced by manual and roller handling of the blanks. Roller leveling is at the heart of the mechanical defects problem since it is here where the bulk of the losses due to handling-related defects occur.

Roller leveling is particularly vexatious with slot mask blanks. A typical roller leveling sequence for slot mask blanks might comprise two passes at a loose roller setting, with the blanks being fed through the leveler along the major axis of the blank (slots parallel to the rollers), the second pass being with the blanks rotated 180°. If the blanks are not rotated, the tie-bars are apt to tear during press-forming.

Next the blanks are passed through the roller leveler two or more times with the blanks skewed such that the slot lines make a substantial angle with respect to the rollers, 60°–70° for example.

Because the blanks are skewed to near maximum width during the second set of passes, special purpose wide-span roller levelers must be used. This capital requirement adds to the expense of roller leveling slot masks.

Having given an outline description of a standard mask making process through the roller leveling operation, it is now possible to understand the inter-relationship between the anneal and roller leveling operations and objectives they are intended to accomplish in the manufacture of shadow masks. This requires in turn a knowledge of certain metallurgical phenomena and the part that this phenomena plays in shadow mask manufacture, particularly how these phenomena relate to the introduction of handling-related mechanical defects and stretcher strains into shadow mask blanks.

Reference will now be had to FIG. 2 which is a stress-strain curve for a typical annealed low carbon rimmed steel such as No. 1008 steel commonly used in the manufacture of shadow masks. In FIG. 2 the X axis represents the strain or elongation which the material experiences when it is subjected to varying values of stress (plotted on the vertical axis).

Region A of the curve is the region of elastic deformation. In this region, no permanent deformation of the blank takes place. Point B on the curve is the yield point, beyond which permanent deformation of the blank takes place. In a material such as annealed rimmed steel, the transition between the region of elastic deformation A and the region of plastic deformation D is not smooth. A transition region, termed the yield point elongation (the region between points B and C on the FIG. 2 curve), is a region where the material plastically deforms in a nonuniform manner. One manifestation of such nonuniform elongation is a fluting or streaking on the surface of the drawn part, termed above "stretcher strains" or "Luder lines".

Stretcher strains mar the finish of an article, making it unsuitable for enameling, for example. In shadow mask manufacture, stretcher strains occurring in the perforate region of a shadow mask indicate a nonuniform stretching of the aperture pattern. A nonuniformly stretched aperture pattern will produce a nonuniform appearance of the black grille comprising part of the phosphor screen and will give the screen an unacceptable appearance when the receiver is off. If the nonuniform stretching of the perforate section of the mask is severe, it could result in such degradation of the color fidelity in the pictures reproduced that the containing CRT would have to be rejected. Typically, non-uniform elongation in the perforate region of the mask blank greater than 0.5% is not acceptable.

In the manufacture of deep drawn parts, where the drawiang takes place in the region D of the stress-strain curve, the nonuniform elongation region is of no consequence. However, in the manufacture of shadow masks the perforate region of the mask is stretched only very slightly-for example, 0.5–2%. This places the drawing of the perforate region of shadow mask in the troublesome region of yield point elongation. It is therefore mandatory that the yield point elongation, that is, the transition region of the curve between points B and C, be eliminated or be reduced preferably to a value no more than 0.5–1.0%. Any value of yield point elongation greater than 1.0% will cause unacceptable nonuniformities in stretching of the perforate region of the mask.

This leads us back to a discussion of the interplay between the annealing and roller leveling operations and the parts these operations play in the reduction to tolerable levels of the magnitude of the yield point elongation. The yield point elongation in the past has been reduced by a combination of annealing and roller leveling.

The way in which annealing is used to reduce the magnitude of the yield point elongation will now be described. The primary purpose of the annealing operation in the conventional mask-making process is to fully recrystallize the steel material comprising the blank in order to render it sufficiently ductile to be formed. It is known that in annealing operations, the higher the annealing temperatures employed, the less will be the magnitude of the yield point elongation of the annealed material. Studies of shadow mask blanks made from No. 1008 rimmed steel have shown that if the maximum annealing temperature is in the order of about 700° C., the yield point elongation will be 4–5%. For maximum annealing temperatures in the order of about 800° C., the yield point elongation of the resulting mask blanks will be about 3.5%. At temperatures in the order of about 900°–950° C., the yield point elongation will be reduced to about 2.5% due to enlarged grain size.

Roller leveling is an operation in which the steel sheet is flexed back and forth by passing it between the nibs of series of rollers in undulation manner to cause the surfaces of the sheet to be very slightly plastically deformed. The end result is that the surface of the material is strained beyond the region of nonuniform elongation (region B-C in FIG. 2) such that when the blank is press-formed, it is deformed in the uniform plastic deformation region of the stress-strain curve (region D in FIG. 2).

It is known from practical experience that the yield point elongation can be reduced by roller leveling by no more than about 2.5%. Thus it is seen that by using a very high temperature anneal, 900°–950° C., for example, and by following this with a severe roller leveling operation, the yield point elongation can be reduced to near zero. This is the approach that is taken in the manufacture of dot-type shadow masks.

Since a dot mask blank is symmetrical, with no very narrow bridge regions, a dot mask blank can be given a severe roller leveling in any desired direction and with rollers adjusted for maximum flexing. The anneal cycle can be held to about two hours or slightly less in the annealing of dot type mask blanks, with the result that although there is some thermally induced sticking of the masks, sticking is not an intolerable problem. Vibration has not been necessary to separate dot mask blanks, if a limited number of mask blanks per stack are used.

As mentioned, because the anneal cycle is not excessively long, even though a limited number of mask blanks can be annealed at a time (thereby avoiding the sticking problem), the overall throughput rate of the annealer is acceptable. However, slot type mask blanks offer a special set of problems.

Because of the bilateral symmetry of slot type mask blanks, and the narrowness of the tie bars, a slot mask blank can be given only a very mild roller leveling. Specifically, it has been found that no more than about 1.5% yield point elongation can be eliminated by roller leveling of slot mask blanks. Since only 1.5% yield point elongation can be eliminated by roller leveling, the balance of the reduction must be accomplished in the annealer. The implication is that the cool-down rate must be substantially slowed, causing the annealing time to be greatly extended. The slower cool-down rate, such that the overall anneal cycle is 3½–5½ hours (versus 2 hours or less for dot mask blanks) will produce end-product annealed mask blanks with larger grain sizes and about 1.5% yield point elongation. As explained, a yield point elongation of 1.5% can be overcome by roller leveling of slot mask blanks.

It is evident then that the dot mask approach in which a high temperature, relatively fast anneal of a limited number of blanks is used, is possible only because dot mask blanks can withstand a harsh roller leveling. Slot mask blanks, being incapable of withstanding a severe roller leveling, must be given a long anneal cycle to overcome the yield point elongation problem. In both cases the throughput of the annealer places a definite limit on the number of masks which can be made in a given period.

Further, in spite of the great attention given to the press-forming properties of mask blanks; their ductility at the press-forming stage is only marginally satisfactory. It is not uncommon for losses to occur during press-forming due to tearing of the regions of the mask blank experiencing the deepest draw.

How does the program of annealing and roller leveling affect the introduction of handling-related mechanical defects? As mentioned, the bulk of the handling-related mechanical defects occur in the roller leveling operations. Even though slot mask blanks are roller leveled less severely than dot mask blanks, the slot mask blank is more delicate and high losses nevertheless obtain. The high temperature annealing of dot and slot mask blanks results in severe wrinkling of the blanks which in turn is translated into losses due to roller marks in the roller leveler.

Further, slot mask blanks must be vertically spaced in the annealer if an acceptable throughput rate is to be achieved. The spacer screens in turn create problems by creating spacer screen particles which are apt to be rolled in the roller leveler to form pimple dents in the mask blanks. Further, as iterated above, any handling of the mask blank, whether it be at a vibrating table or a roller leveler, will introduce a certain percentage of losses due to handling-related defects. As noted above, it has long been desired to devise a mask manufacturing process which did not require roller leveling.

Yet another drawback of the high temperature annealing operation employed for both dot mask blanks and slot mask blanks is that the high temperatures result in the growth of large ferrite grains which are apt to cause an "orange peel" marring of the surface of the shadow mask blank.

More importantly, a high temperature anneal causes not only a larger grain size, but a wide variation in the size of the grains. The grain diameter might vary across a mask blank from 0.04–0.07 millimeters, for example. A wide variation in grain size leads to a nonuniform stretching of the blank during the press-forming operation, especially in the tie-bar areas. Ideally, for best press-forming, the grain size should be small and uniform.

Now back to FIG. 1. Upon emergence from the roller leveler, the mask blank is flat and has suitable ductility for immediate press-forming (Step M). The final operation depicted in FIG. 1 is the press-forming operation (Step N), where the blanks are clamped and drawn into dish-shaped shadow masks (Step O). However, if the blanks are not press-formed within a matter of hours, they will spontaneously age harden and be unsuitable for press-forming. The requirement to immediately press-form the roller-leveled blanks constrains the flexibility of operations in a CRT manufacturing facility.

To overcome these seemingly inescapable mask losses and other cost and operations burdens plaguing the prior mask making methods, numerous attempts have been made by the manufacturers of shadow masks to develop superior mask making processes but, to date, none has proven successful in displacing the standard mask making process employing a high temperature anneal and roller leveling.

U.S. Pat. Nos. 3,909,311 and 3,909,928 describe variants of an experimental mask making process in which roller leveling is said to be obviated by the use of a pre-annealed steel foil, that is, a foil which has been annealed before, rather than after, the foil is etched. The foil is subjected to a 0.5–2% skin pass after the pre-anneal operation but before etching of the aperture pattern in the foil. It has been found, however, from practical experience, that the process involving pre-annealing and skin passing of the foil before it is etched has a critical shortcoming. The high temperatures involved in baking the photoresist layer on the foil before the photoetching operation causes an accelerated aging of the material which cannot be compensated by roller leveling or any operation short of another high temperature full anneal treatment of the blanks.

A related experimental prior art process is known in which a pre-annealed foil is used, but rather than subjecting the foil to a skin pass, a steel of the aluminum-killed or silicon-killed type is used. Practical experience has again shown that this process also suffers from the same critical deficiency as the afore-described pre-annealed and skin-passed material—that is, a typical photoetching operation will introduce an aging of the material which intolerably degrades the drawing properties of the material.

Also, the use of a pre-annealed steel material is apt to give rise to a high coercive force in the end-product masks unless the pre-annealing (at the coil stage) of the material is extremely carefully controlled. This is an undesirable result because it inevitably demands the use in the television receiver of a more powerful (and costly) degaussing system.

Further, both of the afore-described methods utilizing pre-annealed materials have the very serious drawback that losses due to handling-related mechanical defects will occur preliminary to and during the photoetching operations which are attributable to the softness of the pre-annealed material. In addition, because pre-annealing is thermally less efficient than annealing after the photoetching step, an energy cost penalty necessarily attends methods employing a pre-annealed steel stack.

Non-aging steels for suppression of stretcher strains and enhancement of drawability are known. See, for example, U.S. Pat. Nos.:

| | |
|---|---|
| 3,642,468-Nagashima et al | 3,666,570-Korchynsky et al |
| 3,544,393-Zanetti | 3,558,370-Boni |
| 3,239,390-Matsukura et al | 2,999,749-Saunders et al |
| 3,348,980-Enrietto | 3,183,078-Ohtake et al |
| 3,765,847-Behl | |

OBJECTS OF THE INVENTION

It is a primary object of this invention to provide an improved color CRT shadow mask.

It is a primary object of this invention to provide an improved method of making shadow masks for color television cathode ray tubes—particularly shadow masks of the slot type. More particularly, it is a primary object to provide a method of making shadow masks which results in the elimination or near elimination of all handling-related mechanical defects normally introduced during the manufacture of shadow masks.

It is a corollary object to provide an improved method of shadow mask manufacture which produces very significant economies as a result of substantially reduced losses due to handling-related mechanical defects introduced during mask manufacture.

It is a specific object to provide a method of shadow mask manufacture which utilizes a material in its full hard state during and preliminary to photoetching of the mask foil, thus minimizing losses due to denting and scratching which might otherwise occur during those operations, yet which for the first time also makes possible elimination of handling-related mechanical defects normally introduced during the typical high temperature annealing operation and the subsequent roller leveling operations. Among the handling-related mechanical defects which are eliminated are the creases, dents and other manual handling marks normally associated with manual handling of the mask blanks at the vibrating table and roller leveler, and the roller marks introduced at the roller leveler.

It is a secondary but important object to provide an improved method of shadow mask manufacture which makes possible substantial economies of mask manufacture attributable to: (1) a vastly increased annealer throughput rate, (2) elimination altogether of the normal vibrating table and roller leveler and reduction in the annealing oven requirements, with the attendant savings in labor, capital and maintenance, and (3) the elimination of a high temperature annealing operation with the consequent savings primarily in energy, labor, and spacer consumption.

It is yet another secondary object to provide an improved method of mask manufacture which results in the production of mask blanks which do not have the tendency to age. It is thus a corollary object to provide a method which enhances flexibility of operations within a CRT factory.

It is still another secondary object of this invention to provide a method of shadow mask manufacture which produces mask blanks which show little or no tendency to the formation of stretcher strains. It is a corollary object to provide a method of shadow mask manufacture which results in end product cathode ray tubes having improved grille uniformity as a result of a more uniform stretching of the shadow mask blanks in the apertured region.

It is still another object to provide a method shadow mask manufacture which results in mask blanks of much greater ductility than blanks made by conventional processes, and consequently less tearing of the mask blanks during the press-forming operations. This property is especially important in the manufacture of masks, such as frameless type one-piece masks, which have sections with deeper draws and greater distortion than conventional shadow masks.

It is still another object to provide a method of shadow mask manufacture which produces mask blanks ready for press-forming with greater ductility and a narrower yield point range than prior mask blanks and thus which have better forming characteristics due to less variation in stretching properties within a given blank and from blank to blank.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in which:

DESCRIPTION OF THE PREFERRED EMBODIMENTS

Figure 3:
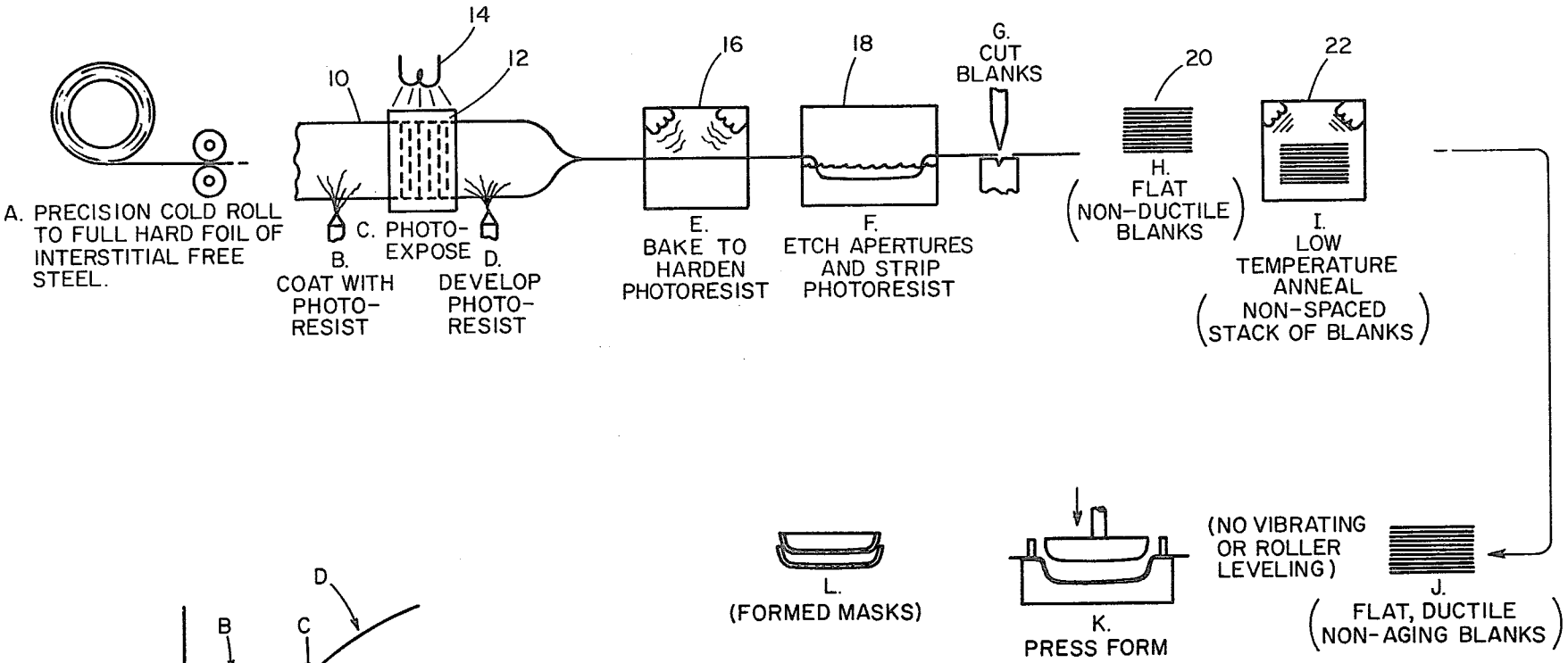
FIG. 3 is a flow diagram of a method for making color CRT shadow masks according to the present invention.
Figure 2:
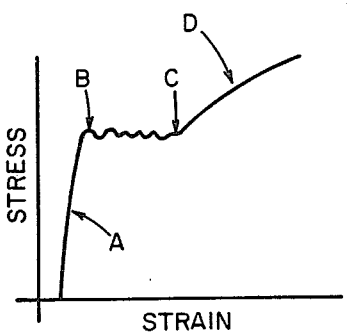
FIG. 2 is a stress-strain curve for a shadow mask blank composed of annealed low carbon steel No. 1008.

FIG. 3 is a flow diagram depicting basic steps and stages of a preferred implementation of the present method invention. It should be understood that a number of subsidiary steps have been omitted in order not to obscure the present invention.

Step A schematically depicts a first step in the improved method wherein a sheet of foil 10 of steel, the composition of which forms an important part of the present method (to be described later), is precision cold-rolled from, for example, 24–30 mils to a foil thickness of between about 6–8 mils with a precision of ±0.1–0.3 mil. Cold-rolling of the material from about 25 mils to about 6–8 mils work hardens the material such that it is in a "hard-rolled" or "full hard" condition.

In accordance with this invention, the foil 10 is not composed of rimmed steel, as is conventional, but has a very special steel composition, hereinafter termed "interstitial free" steel.

"Interstitial free" steel is herein defined as a low carbon steel in which the carbon and nitrogen atoms in the material are chemically combined with special stabilizers such as titanium, aluminum, zirconium and/or niobium which combine with the nitrogen and carbon to form nitrides and carbides. For example, if aluminum and titanium are used, aluminum and titanium nitrides and titanium carbide is formed.

Whereas free nitrogen and carbon have the property of pinning dislocations in the lattices of the steel material, thus causing a yield point elongation during press forming, carbides and nitrides do not have this adverse property. As a result, interstitial free steel is substantially completely free of the aging characteristic which plagues the conventional rimmed steels. Other advantages and properties of interstitial free material will be described at length hereinafter.

It has been found that the carbon levels in the steel material before stabilization may vary and need not be extremely low. One supplier of interstitial free steel stabilizes a 1008 aluminum-killed steel to produce its interstitial free product (carbon level 0.08%). To reduce the quantity of stabilizer(s) required for stabilization, another supplier decarburizes 1008 steel to about 0.01–0.004% carbon before stabilizing (primarily with titanium).

There follows a specification of an interstitial free ("IF") steel material suitable for use in the practice of this invention, as it appears in coil form prior to photoetching, that is, as in step A in FIG. 3.

Chemical Compositions:

| SAMPLE 1 | | |
|---|---|---|
| IF Steel | Element | Weight Percent |
| Niobium | Carbon | 0.004–.01 |
| | Niobium | 0.08–.12 |
| | Titanium | — |
| | Manganese | 0.10–0.35 |
| | Sulfur | 0.02 Max. |
| | Phosphor | 0.01 Max. |
| | Aluminum | 0.015 Min. |
| | Nitrogen | 0.004 |
| | Iron | BALANCE |

Chemical Compositions:

| SAMPLE 2 | | |
|---|---|---|
| IF Steel | Element | Weight Percent |
| (Nb-Ti) | Carbon | .004–.01 |
| | Niobium | 0.03–.06 |
| | Titanium | 0.04–.06 |
| | Manganese | 0.1–.35 |
| | Sulfur | 0.02 Max. |
| | Phosphor | 0.01 Max. |
| | Aluminum | 0.015 Min. |
| | Nitrogen | 0.004 |
| | Iron | BALANCE |

Mechanical Properties:

The sheet shall be cold rolled by small amounts to thickness as specified and shall have the following properties:

| | |
|---|---|
| Tensile Strength | 95,000 psi |
| Yield Strength | 90,000 psi min. |
| Hardness | Rockwell B 95 min. |
| Elongation | 1–2% |
| Grain Size | ASTM 8, or finer after last anneal. |
| Y.P. Elongation | 0 |

Surface Finish:

A. Free from pits, scratches, slitting burrs, laminations.
B. Smoothness: 6–12 Rms micro inches on profilometer.
C. Inclusions: Minimum consistent with good steel making practice. Must be well-dispersed for good etching practice.
D. Surface must be clean and free of rust.

Figure 1:
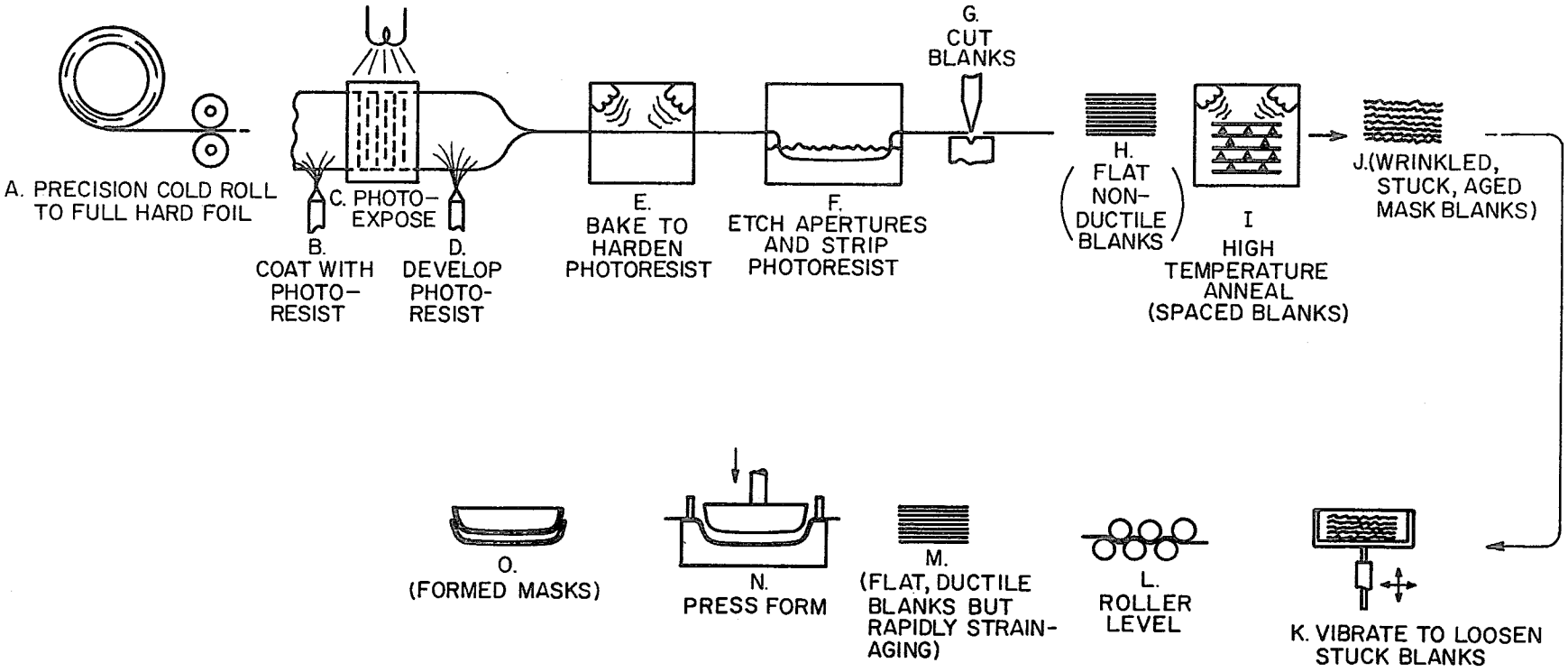
PRIOR ART Fig. 1
FIG. 1 is a schematic flow diagram depicting a method of making color CRT shadow masks according to a conventional practice.

Steps B through G are essentially the same as shown and described above in the conventional FIG. 1 process and are well known in the art. After the coil is cut and wound, it is ready to be made into a mask. The mask maker feeds the foil 10 into an in-line photoetching operation wherein the foil has formed therein spaced patterns of apertures. The photoetching operation includes coating both sides of the foil with a layer of photoresist material (Step B). This photoresist may be fish glue or other suitable photosensitive etchant-resistant material. The photoresist layers on opposed sides of the foil are exposed to a light source 14 through registered aperture pattern masters 12 (Step C). The latent images formed in the photoresist layers are then developed by spraying or the like to cause the softened portions of the layers to be removed and the underlying foil exposed.

The photoresist layers are then baked in an oven 16 (Step E) which hardens the photoresist and enables it to withstand the subsequent etching operation (Step F). The etchant 18 may be ferric chloride, as is conventional. The photoresist layers are then chemically stripped (not shown) from the foil by use of a stripping agent (well known).

The foil is then cut into mask blanks 20 (Step G). At Step H in the FIG. 3 method, the perforate mask blanks are flat, but are too hard to be press formed. As in the aforedescribed conventional processes, it should be a full hard foil that is used. As mentioned above, a number of major prior efforts to improve on the conventional process have involved the use of pre-annealed steels. The use of steel which is annealed prior to the etching operation has the serious drawback that it is so soft that it is very apt to be scratched, dented and/or creased during operations preliminary to, during and/or subsequent to the photoetching operations. Thus at this point in the improved method, the flat mask blanks (Step H) have the same relative freedom from scratches, creases and dents as in the standard process, yet, as will be described below, by the use of an interstitial free steel material, numerous advantages are obtained.

Step I reveals schematically the first major departure (aside from the selection of an interstitial free steel stock) from conventional mask making operations. In Step I, a stack of the blanks 20, unseparated by spacers, is subjected to a limited annealing operation. The annealing operation is carried out in an oven 22, which may, for example, be a Lindberg or other standard type annealing oven 22. The annealing operation is characterized by being carried out at a relatively low maximum temperature and for a relatively brief period sufficient to achieve recrystallization of the material without causing significant grain growth. The minimum temperature is within the range of temperatures high enough to achieve recrystallization. The maximum temperature is below the temperature at which the blanks will adhere to one another, thereby avoiding any significant sticking of the blanks and any handling-related denting or creasing of the blanks normally associated with attempts to separate blanks which are stuck together, as happens in conventional high temperature annealing operations. By way of example, the annealing temperature may be in the range of 600°–850° C. The anneal interval, may, for example, be from 1 to 2 hours, but is preferably in the range of about one and one-fourth to one and one-half hours.

Another way of defining the time and temperature criteria for the practice of this invention is—the temperature and time should be such as to achieve full recrystallization of the material and a grain size of about 0.01–0.04 millimeters, preferably about 0.025–0.035 millimeters.

In the aforedescribed conventional mask making method using a high temperature, long duration anneal, the grain size is typically 0.04–0.06 millimeters average. The large grain size is a result of the combined long anneal time and high anneal temperature. Larger grain size results in improved ductility, but the severe anneal causes aging of the material.

In accordance with this invention, the anneal cycle is mild and sufficient to achieve recrystallization of the steel without grain growth to sizes in excess of 0.04 millimeters in diameter.

By virtue of the mask-making method according to this invention, wherein a very mild low temperature anneal is employed, the blanks at the egress of the annealing oven 22 are substantially free of wrinkles, dents, creases, scratches and other handling-related mechanical defects which would be expected if a conventional high temperature annealing operation were employed.

At the output from the annealing oven 22, the blanks are virtually flat. Conspicuously absent are the wrinkles normally found in blanks emerging from conventional high temperature annealing ovens. Also, as a result of the use of interstitial free steel material, the blanks at this stage are ductile and have a unique property of being non-aging. Because the blanks are non-aging, they can be stored for long periods of time with little concern for the introduction of stretcher strains during any subsequent press-forming operation.

Upon emergency from the annealing oven 22, the blanks 20 have substantially higher ductility than do mask blanks annealed according to the conventional mask making processes. By way of example, using the standard thinning ratio test, whereas a rimmed steel blank might typically have a thinning ratio of 1.2, the blanks at Step J of my improved process after annealing might typically have a thinning ratio of 1.8, an improvement of 50% in this important ductility measurement.

A high value of ductility is of extreme importance in shadow mask manufacture since it is necessary in order to obtain the press-forming precision required. Without adequate ductility, the "spring back" in the press-formed masks will produce unacceptably poor shape accuracy.

Because the annealing temperature is kept below that at which the blanks will stick together, spacers are not required during the annealing operation. The elimination of spacers completely avoids any possibility of scratching the mask blanks by the insertion and removal of spacers, and avoids the substantial cost of the spacers, both in terms of the labor necessary for their introduction and withdrawal, and their replacement and maintenance. Also saved are the substantial numbers of mask blank rejects which would be expected as a result of the disintegration of the spacers. Spacer disintegration in the conventional process causes clogging of the apertures in the mask blank by particulate matter. More importantly, particulate matter lodging on the mask blanks is too often rolled into pimple dents during the subsequent roller leveling operations.

Still further, because of the elimination of any sticking problem and the obviation of spacers, a much taller stack of blanks can be annealed in a given time period than was possible in the previous mask manufacturing method.

In one successful test, a Lindberg oven, as described, was set to a control temperature of 1500° F. The anneal was conducted in an atmosphere of dry nitrogen. The belt speed was 6 inches per minute. The blanks were stacked 10 high and 15 high, without spacers. In another test, a control temperature of 1520° F. was used; the blanks were stacked 15 high, 20 high and 30 high, without spacers. All blanks formed satisfactorily without need for vibration to separate or roller leveling.

It is expected that with this method, 700 slot mask blanks per hour (over 4 million per year) may be annealed in a single Lindberg oven of the type described. This contrasts with only 160 slot mask blanks per hour (less than one million per year) using the conventional high temperature process used previously.

Because of the use of a low temperature anneal in the method of this invention, no vibrating table or other special apparatus or treatment is necessary in order to loosen the mask blanks upon emergence from the annealing oven. Tests have shown that the mask blanks are virtually flat and have no tendency to stick. Elimination of the vibrating table found in conventional processes for the purpose of loosening stuck masks, eliminates all handling-related mechanical defects which attend the use of a vibrating table of the like. As mentioned above, at any site of manual handling of the fragile mask blanks, a significant percentage of the blanks will inevitably be lost due to creases, dents, scratches and the like.

Further, because the mask blanks have no aging tendency (and thus no tendency to form stretcher strains during the press-forming operation), and since the blanks are flat, the conventional roller leveling operation may also be completely eliminated. Elimination of roller leveling is a goal which has been sought by the manufacturers of shadow masks since the earliest days of shadow mask manufacture. As described in detail above, the roller leveling station is the station where the bulk of the handling-related mechanical defects are introduced. The blanks must be fed through the roller leveler many times. Each time the blank is handled, there exists the very real possibility that a crease, dent, or scratch will be introduced. Further, any possibility of roller mark damage by the roller leveler itself is eliminated. In addition, roller leveling introduces work hardening of the blank. Work hardening increases the likelihood that the blank will be torn when it is press formed.

Elimination of the roller leveling step and the vibrating table effect substantial economies beyond the savings in losses due to mechanical defects imparted to the blanks. Elimination of these operations offers substantial savings in labor, capital and maintenance of this equipment, as well as freeing space on the factory floor for other operations. The use of a low temperature, short duty cycle annealing operation, rather than the high temperature long cycle anneal used in the standard mask manufacture methods, substantially lessens the cost burden not only in terms of consumed energy, but also as a result of the increased mask blank throughput rate (which leads to a reduced need for capital equipment).

Let us return to FIG. 3. After being annealed in the annealing oven 22, the mask blanks may be stored for a substantial period of time (for example, for several months) without the blanks aging significantly.

In the press forming step (Step K) the blanks are clamped and drawn into a dished shadow mask configuration. As described, because the blank is so much more ductile than mask blanks resulting from the use of previous methods of mask manufacture, the resulting masks 28 are more apt to be free of tears than masks made by prior processes. Further, because the yield point elongation is virtually zero for blanks made according to the present process, the tendency of press-formed masks to have stretcher strains formed on the surfaces thereof is substantially completely eliminated. The elimination of stretcher strains means a more uniform stretching of the perforate portion of the shadow mask, and a consequent improvement in the quality of the black grille formed during the faceplate screening operations.

Still further, by the use of the method of this invention, it has been found that the yield stress from mask blank to mask blank and at different points within a given blank fall within a much narrower range than with the blanks made by prior processes. This fact is attributed to the uniform recrystallization grain size in the interstitial free steel material which may range, in some cases, from 0.025–0.035 millimeters grain diameter.

The following chart summarizes a number of the important features of the present method as applied to the manufacture of slot-type shadow masks, as compared with conventional methods for making dot-type and slot-type masks.

| | DOT MASK PRIOR METHOD | SLOT MASK PRIOR METHOD | SLOT MASK THIS METHOD |
|---|---|---|---|
| Anneal Temperature | High | High | Low |
| Annealing Time | Moderate | Long | Short |
| Post Anneal Grain Size | .035–.05 mm | .04–.06 mm | .01–.04mm |
| Vibrating Operation | None | Harsh | None |
| Roller Leveling | Harsh | Constrained | None |
| Handling-Related Mechanical Defects | Major losses caused | Major losses caused | Very minor losses caused |
| Annealer Throughput Rate | 400–500 per hour | About 160 per hour | About 700 per hour |

By the practice of the improved method according to this invention, shadow masks may be made with significantly reduced losses from such handling-related mechanical defects as denting, creasing, scratching, tearing and the like with the result that substantial manufacturing economies result. Further, in part because of the improved ductility, freedom from stretcher strains and the narrowness of the range of yield points, the end product mask is superior to that made by conventional methods.

While a particular method of the invention has been shown and described, it will be obvious to those skilled in the art that changes and modifications may be made without departing from the invention in its broader aspects, and, therefore, the aim in the appended claims is to cover all such changes and modifications as fall within the true spirit and scope of the invention.

I claim:

1. An improved method of making a color CRT shadow mask composed of a very thin steel foil material and having a pattern of apertures therein, such mask being highly susceptible to denting, creasing, scratching, tearing and other unacceptable handling-related mechanical defects attributable in large part to the fragility of the mask, the improved method resulting in significantly reduced looses from such handling-related mechanical defects and thus effecting substantial manufacturing economies, and a superior product as well, the method comprising:

providing a plurality of shadow mask blanks each with a pattern of apertures photoetched therein, which blanks have been cut from a foil of steel, precision cold-rolled to a full hard condition with a thickness of about 6–8 mils, said foil being characterized by being composed of an interstitial free steel material;

subjecting a stack of said blanks to a limited annealing operation, said annealing operation being characterized by being carried out at a relatively low maximum temperature and for a relatively brief period sufficient only to achieve recrystallization of the material without causing significant grain growth, said maximum temperature being below the temperature at which the blanks mutually adhere, said relatively low maximum temperature being effective to avoid any significant sticking together of said blanks, thus avoiding any handling-related folding or creasing of the blanks normally associated with attempts to separate blanks stuck together in conventional high temperature annealing operations, said blanks being substantially free of dents, creases, scratches and other handling-related mechanical defects which would be expected if the conventional high temperature anneal were employed; and, clamping and drawing each blank to form a dished shadow mask without the interposition of vibration or roller leveling operations and thereby avoiding undesirable creasing, roller marking, denting, tearing or work hardening of the blank normally associated with these operations, whereby the end product shadow mask, due to the use of a full hard, interstitial free steel material, and the obviation of a high temperature anneal and the necessary consequent vibration and roller leveling, is comparatively free of the aforesaid handling-related mechanical defects and is thus much less costly to manufacture than prior masks despite the higher initial material cost, and whereby the end product shadow mask, due to the use of said interstitial free steel material, has an aperture pattern of improved definition as a result of more uniform stretching of the mask blank.

2. The method defined by claim 1 wherein said annealing operation is carried out at a maximum temperature of about 750° C. for about 1¼ hours.

3. An improved method of making a color CRT shadow mask composed of a very thin steel foil material and having a pattern of apertures therein, such mask being highly susceptible to denting, creasing, scratching, tearing and other unacceptable handling-related mechanical defects attributable in large part to the fragility of the mask, the improved method resulting in significantly reduced losses from such handling-related mechanical defects and thus effecting substantial manufacturing economies, and a superior product as well, the method comprising:

providing a plurality of shadow mask blanks each with a pattern of apertures photoetched therein, which blanks have been cut from a foil of steel, precision cold-rolled to a full hard condition with a thickness of about 6–8 mils, said foil being characterized by being composed of an interstitial free steel material;

subjecting a stack of said blanks to an annealing operation, said annealing operation being characterized by being carried out at a relatively low maximum temperature and for a time material effective to cause said steel material to have a grain size between about 0.01–0.04 mm, said relatively low maximum temperature being effective to avoid sticking together of said blanks, thus avoiding any handling-related folding or creasing of the blanks normally associated with attempts to separate blanks stuck together in conventional high temperature annealing operations, said blanks being substantially free of wrinkles, dents, creases, scratches and other handling-related mechanical defects which would be expected if the conventional high temperature anneal were employed; and clamping and drawing each blank to form a dished shadow mask without the interposition of vibration or roller leveling operations and thereby avoiding undesirable creasing, roller marking, denting, tearing or work hardening of the blank normally associated with these operations, whereby the end product shadow mask, due to the use of full hard interstitial free steel material, and the obviation of a high temperature anneal and the necessary consequent vibration and roller leveling, is comparatively free of the aforesaid handling-related mechanical defects and is thus much less costly to manufacture than prior masks despite the high initial material cost, and whereby the end product shadow mask, due to the use of said interstitial free steel material, has an aperture pattern of improved definition as a result of more uniform stretching of the mask blank.

4. The method defined by claim 3 wherein said annealing operation is carried out at a maximum temperature of about 600°–850° C. for about 1 to 1½ hours.

5. An improved method of making a color CRT shadow mask composed of a very thin steel foil material and having a pattern of apertures therein, such mask being highly susceptible to denting, creasing, scratching, tearing and other unacceptable handling-related mechanical defects attributable in large part to the fragility of the mask, the improved method resulting in significantly reduced losses from such handling-related mechanical defects and thus effecting substantial manufacturing economies, and a superior product as well, the method comprising:

providing a plurality of shadow mask blanks each with a pattern of apertures photoetched therein, which blanks have been cut from a foil of steel, precision cold-rolled to a full hard condition with a thickness of about 6–8 mils, said foil being characterized by being composed of an interstitial free steel material;

subjecting a stack of said blanks, unseparated by spacers, to a limited rapid annealing operation, said annealing operation being characterized by being carried out at a relatively low maximum temperature in the range of about 600°–850° C. and for time effective to achieve full recrystallization of the material and a grain size of about 0.025–0.035 millimeters, said relatively low maximum temperature being effective to substantially completely avoid any sticking together of said blanks, thus avoiding any handling-related folding or creasing of the blanks normally asssociated with attempts to separate blanks stuck together in conventional high temperature annealing operations, said blanks being substantially completely free of wrinkles, dents, creases, scratches and other handling-related mechanical defects which would be expected if the conventional high temperature anneal were employed; and clamping and drawing each blank to form a dished shadow mask without the interposition of vibration or roller leveling operations and thereby avoiding undesirable creasing, roller marking, denting, tearing or work hardening of the blank normally associated with these operations, whereby the end product shadow mask, due to the use of full hard interstitial free steel material, and the obviation of a high temperature anneal and the necessary consequent vibration and roller leveling, is comparatively free of the aforesaid handling-related mechanical defects and is thus much less costly to manufacture than prior masks despite the higher initial material cost, and whereby the end product shadow mask, due to the use of said interstitial free steel material, has an aperture pattern of improved definition as a result of more uniform stretching of the mask blank.

6. The method defined by claim 5 wherein said annealing operation is carried out at a maximum temperature of about 750° C. for about 1¼ hours.

7. An improved method of making a color CRT slot-type shadow mask composed of a very thin steel foil material and having an aperture pattern in the form of parallel rows of aligned elongated slots separated by narrow tie-bars, such masks being highly susceptible to denting, creasing, scratching, tearing and other unacceptable handling-related mechanical defects attributable in large part to the fragility of the mask, the improved method resulting in significantly reduced losses from such handling-related mechanical defects and thus effecting substantial manufacturing economies, and a superior product as well, the method comprising:

providing a plurality of shadow mask blanks each with a pattern of slots photoetched therein, which blanks have been cut from a foil of steel, precision cold-rolled to a full hard condition with a thickness of about 6–8 mils, said foil being characterized by being composed of an interstitial free steel material;

subjecting a stack of said blanks, unseparated by spacers, to an annealing operation, said annealing operation being characterized by being carried out at a relatively low maximum temperature in the range of 600°–850° C. for a time effective to achieve full material and a grain size of about 0.025–0.035 millimeters said relatively low maximum temperature being effective to substantially completely avoid any sticking together of said blanks, thus avoiding any handling-related folding or creasing of the blanks normally associated with attempts to separate blanks stuck together in conventional high temperature annealing operations, said blanks being substantially completely free of wrinkles, dents, creases, scratches and other handling-related mechanical defects which would be expected if the conventional high temperature anneal were employed; and clamping and drawing each blank to form a dished shadow mask without the interposition of vibration or roller leveling operations and thereby avoiding undesirable creasing, roller marking, denting, tearing, or work hardening of the blank normally associated with these operations, whereby the end product shadow mask, due to the use of full hard interstitial free steel material, and the obviation of a high temperature anneal and the necessary consequent vibration and roller leveling, is comparatively free of the aforesaid handling-related mechanical defects and is thus much less costly to manufacture than prior masks despite the higher initial material cost, and whereby the end product shadow mask, due to the use of said interstitial free steel material, has a slot pattern of improved definition as a result of more uniform stretching of the mask blank, and has greater uniformity in shape from mask to mask due to the narrowness in the range of yield points within a given mask and from mask to mask.

8. The method defined by claim 7 wherein said annealing operation is carried out at a maximum temperature of about 750° C. for about 1¼ hours.

9. An improved color CRT shadow mask made according to the method of claims 1, 5, or 7.

* * * * *